US006388953B1

(12) United States Patent
Wu

(10) Patent No.: US 6,388,953 B1
(45) Date of Patent: May 14, 2002

(54) MAGNETICALLY DRIVEN DYNAMIC ORNAMENT

(76) Inventor: Teng-Yang Wu, 2Fl., No 18, Alley 35, Lane 91, Sec. 1, Neihu Rd., (114) Taiwan (TW)

( * ) Notice: Subject to any disclaimer, the term of this patent is extended or adjusted under 35 U.S.C. 154(b) by 0 days.

(21) Appl. No.: 09/726,416

(22) Filed: Dec. 1, 2000

(51) Int. Cl.[7] ..... G04B 19/00; G04B 25/00; G04C 21/00

(52) U.S. Cl. ..... 368/76; 368/223; 368/285

(58) Field of Search ..... 368/76, 126, 223, 368/228, 276, 285

(56) References Cited

U.S. PATENT DOCUMENTS 5,272,681 A 12/1993 Lee
5,848,029 A 12/1998 Chang
5,850,373 A * 12/1998 Lee ..... 368/65
6,116,775 A * 9/2000 Masateru ..... 368/285

* cited by examiner

*Primary Examiner*—Vit Miska
(74) *Attorney, Agent, or Firm*—Dougherty & Troxell

(57) ABSTRACT

A magnetically driven dynamic ornament includes a horizontally positioned closed annular chamber having a predetermined width for receiving a dual-liquid ornament therein, and a central chamber surrounded by the annular chamber and having at least one horizontally turnable magnetic body provided therein, such that the magnetic body is in the vicinity of magnetic induction bodies attached to floating decorations in the dual-liquid ornament with only a thin wall between the central chamber and the annular chamber separating the at least one magnetic body from the magnetic induction bodies, enabling the at least one magnetic body to effectively and stably magnetically drive the floating decorations to move in and along said annular chamber to present a dynamic

7 Claims, 5 Drawing Sheets

MAGNETICALLY DRIVEN DYNAMIC ORNAMENT

BACKGROUND OF THE INVENTION

The present invention relates to a magnetically driven dynamic ornament having dual liquids and floating decorations, of which magnetic bodies and magnetic induction bodies are arranged in a way different from that for conventional magnetically driven dual-liquid ornaments, so that floating decorations in the dual liquids are more effectively and stably magnetically driven to move in the ornament.

Liquid ornaments have been developed for a long time and can be generally divided into two types, namely, mono-liquid and dual-liquid ornaments. A conventional dual-liquid ornaments driven by magnetic force typically includes a liquid container and a magnetic source provided outside and below the liquid contain. Thus, the magnetic source is vertically spaced from a floating decoration in the dual-liquid ornament by a distance at least equal to a depth of a lower water layer in the liquid container. And, it is this distance that frequently causes failure of the magnetic source in effectively driving the floating decoration to move in the dual-liquid ornament.

U.S. Pat. No. 5,272,681 discloses a Dynamic Fluid Clock that includes a drive source having a magnetic body provided on a second's dial of the clock. U.S Pat. No. 5,848,029 discloses a Motion Liquid Display Toy that includes a drive source having a shaft that moves once each one-second to push a spherical or a cylindrical body having a magnetic body attached thereto.

All the above-mentioned dual-liquid ornaments with floating decorations to create dynamic visions have the following drawbacks and limitations in their designs:

(A) In the dual-liquid ornament, a floating decoration movably floats at an interface between layer. In designing the dual-liquid ornament, it is a must that the floating decoration does not leave the interface of the two liquids. Moreover, since water at the lower layer of the two liquids has a density larger than that of the floating decoration, it is more difficult to magnetically attract the floating decoration down into the water layer and leave the liquid interface than magnetically attract the floating decoration up into the oil layer. Thus, it is a common practice in manufacturing the dual-liquid ornament to mount a drive source, such as a small motor or a clock movement, and related magnetic body below a bottom of the liquid container, so that the magnetic body is vertically spaced from the floating decoration by the bottom of the liquid container and a depth of the water layer, and the floating decoration is prevented from leaving the liquid interface and/or tightly contacting with the side wall of the liquid container while moving due to an overstrong magnetic attraction of the magnetic body.

(B) To economically mass-produce the dual-liquid ornaments, the weight and buoyancy of the floating decoration, the depth of the water layer, and the intensity of the magnetic attraction of the magnetic body are not precisely controlled in the manufacturing process. It is very possible that the water layer forms a thick barrier to block the attraction of the magnetic body to the floating decoration and adversely affects the intended dynamic display of the dual-liquid ornament.

SUMMARY OF THE INVENTION

It is therefore a primary object of the present invention to provide a magnetically driven dynamic ornament that incorporates a dual-liquid ornament and differently arranged magnetic bodies and magnetic induction bodies to enable effective and stable moving of floating decorations in the dual-liquid ornament.

To achieve the above and other objects, the dynamic ornament of the present invention mainly includes a horizontally positioned closed annular chamber having a predetermined width for receiving a dual-liquid ornament therein, and a central chamber surrounded by the annular chamber and having at least one horizontally turnable magnetic body provided therein, such that the magnetic body is in the vicinity of magnetic induction bodies attached to floating decorations in the dual-liquid ornament with only a thin wall between the central chamber from the annular chamber separating the at least one magnetic body and the magnetic induction bodies, enabling the at least one magnetic body to effectively and stably magnetically drive the floating decorations to move in and along said annular chamber to present a dynamic vision.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
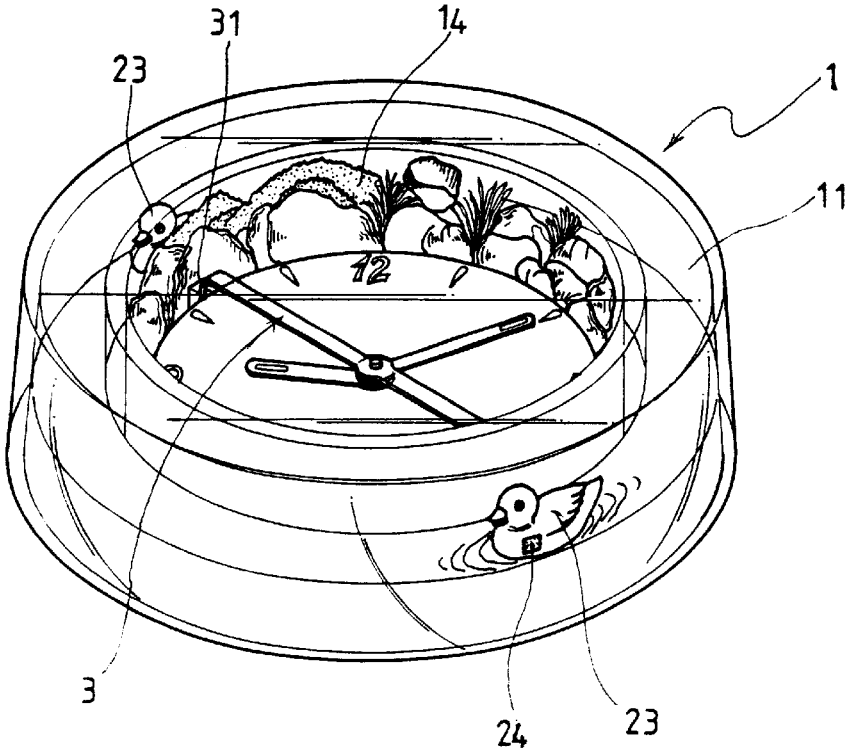
FIG. 1 is a perspective view of a magnetically driven dynamic ornament according to a first embodiment of the present invention.
Figure 2:
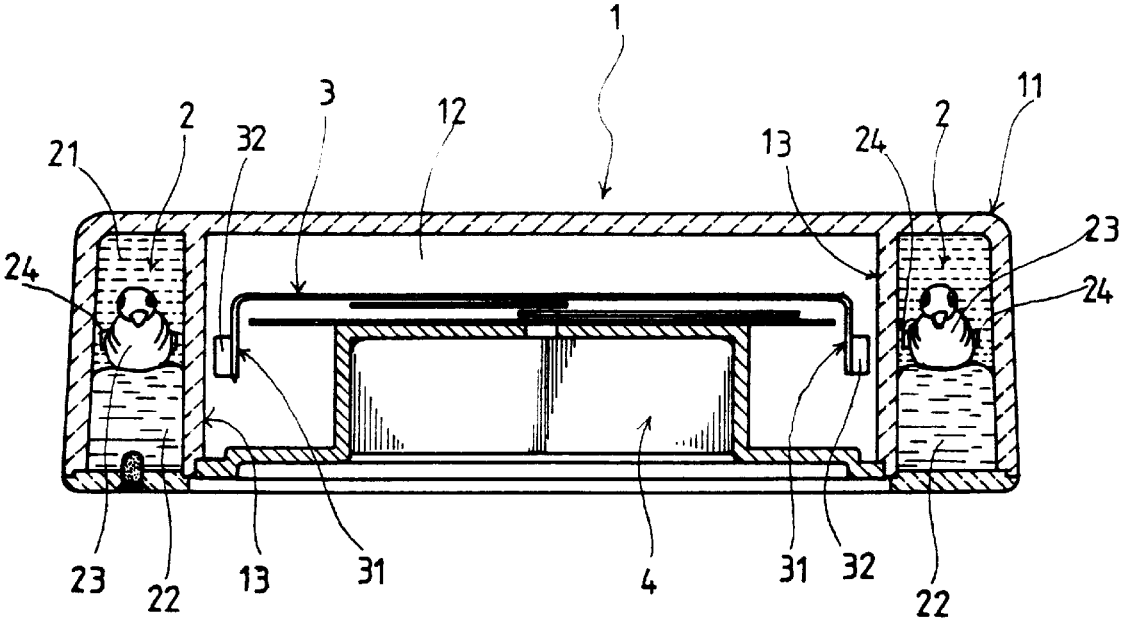
FIG. 2 is a sectional view of the magnetically driven dynamic ornament of FIG. 1.

The present invention relates to a magnetically driven dynamic ornament 1. FIGS. 1 and 2 are perspective and sectional views, respectively, of a first embodiment of the dynamic ornament 1 of the present invention. As shown, the dynamic ornament 1 is in the form of a horizontal clock and has a housing divided into a closed annular chamber 11 and a central chamber 12 surrounded by the annular chamber 11.

The annular chamber 11 has a predetermined width and at least one clear side for receiving and showing a dual-liquid ornament 2 therein. The dual-liquid ornament 2 includes two different types of liquids, namely, oil 21 and water 22 below the oil 21, and an optional number of decorations 23 adapted to float at an interface between the oil 21 and the water 22. The floating decorations 23 are provided on their main bodies, preferably at two lateral sides thereof, with magnetic induction bodies 24, such as small pieces of magnet or iron.

In the central chamber 12, there is a fixedly and horizontally mounted clock movement 4, on a top of which a horizontal turnable member 3 is rotatably mounted. The clock movement 4 is a low-cost mass-produced product adapted to drive an hour hand, a minute hand and a second's dial connected thereto to move in a circular motion, and the circular motion of the second's dial second by second is clearly visible. Thus, the clock movement 4 can be advantageously employed as a drive source in the dynamic ornament 1 of the present invention and the second's dial as the horizontal turnable member 3. Of course, the horizontal turnable member 3 is not necessarily in the form of a round disc as the second's dial connected to the clock movement 4 but may be suitably changed in its configuration. In the dynamic ornament 1 shown in FIGS. 1 and 2, the horizontal turnable member 3 is a double-length second hand. That is, the horizontal turnable member 3 is an elongated member rotatably connected at a middle point to the clock movement 4. A mark of any type is provided on a top surface of the elongated turnable member 3 near one end thereof, so that the end of the elongated member 3 with the mark is used as a second hand. At least one of two ends of the elongated turnable member 3 is downward bent to form a vertical end surface 31. In the illustrated FIGS. 1 and 2, both ends of the elongated turnable member 3 are bent to provide two vertical end surfaces 31. A magnetic body 32, such as a magnet, is attached to each end surface 31 of the elongated turnable member 3. As can be clearly seen from FIG. 2, the magnetic body 32 at this position, that is, attached to the end surface 31 of the elongated turnable member 3, is in the vicinity of the magnetic induction bodies 24 attached to the floating decorations 23. That is, the magnetic body 32 is separated from the magnetic induction body 24 only by a thin wall between the central chamber 12 and the annular chamber 11. Moreover, it is possible for the magnetic body 32 to locate in the central chamber 12 at a height corresponding to the floating decorations 23 in the annular chamber 11. With these arrangements, when the elongated turnable member 3 is driven by the clock movement 4 to move, the magnetic bodies 32 attached to end surfaces 31 of the member 3 effectively and stably magnetically attract the magnetic induction bodies 24 on the floating decorations 23 to drive the latter to move in and along the annular chamber 11 in a circular motion, presenting a dynamic vision in the ornament 1.

Suitable pictures 14 may be printed on or attached to an inner wall surface 13 of the central chamber 12 to provide a background matching with the floating decorations 23 in the annular chamber 11, making the vision in the dynamic ornament 1 more vivid.

Figure 3:
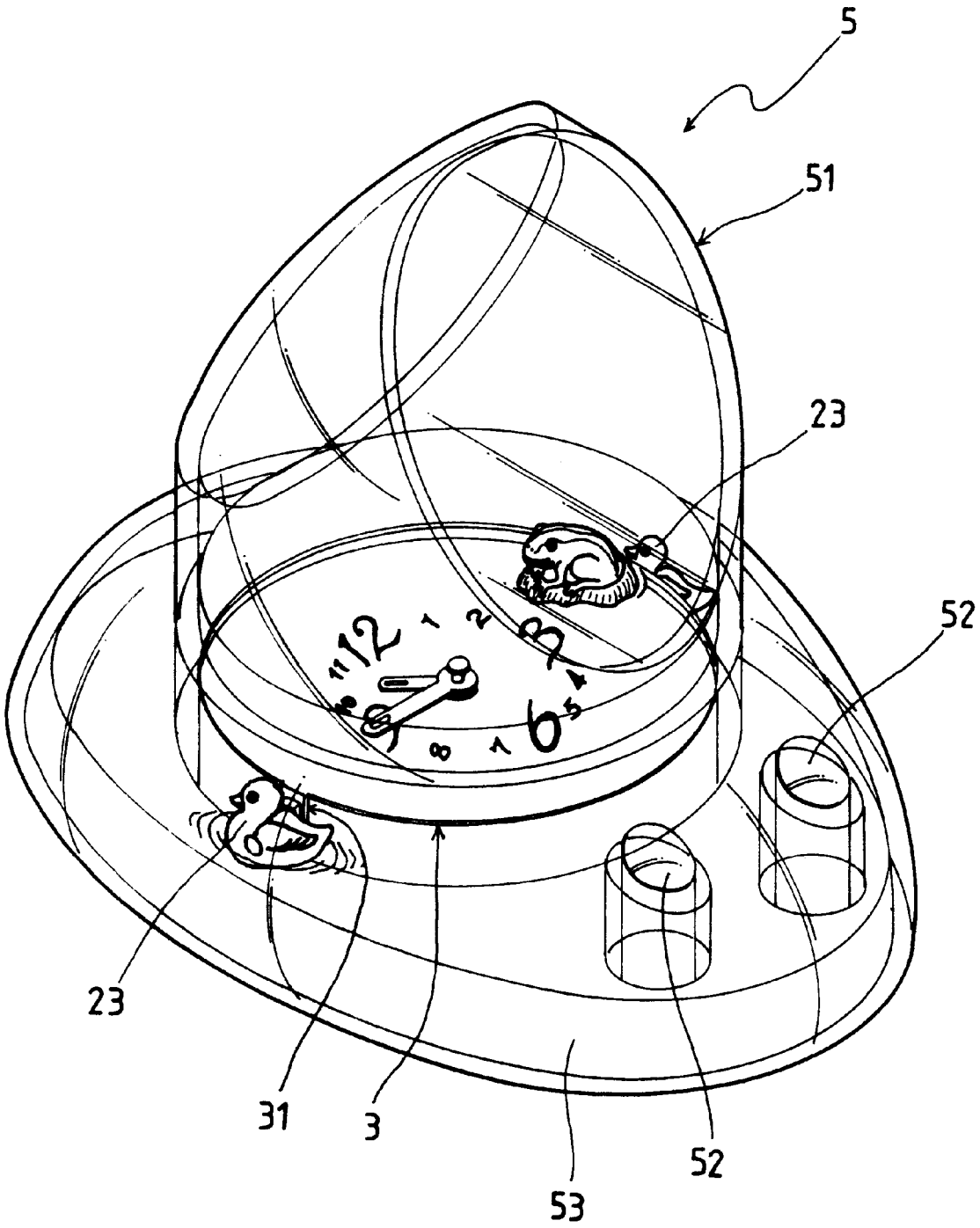
FIG. 3 is a perspective view of a magnetically driven dynamic ornament according to a second embodiment of the present invention.
Figure 4:
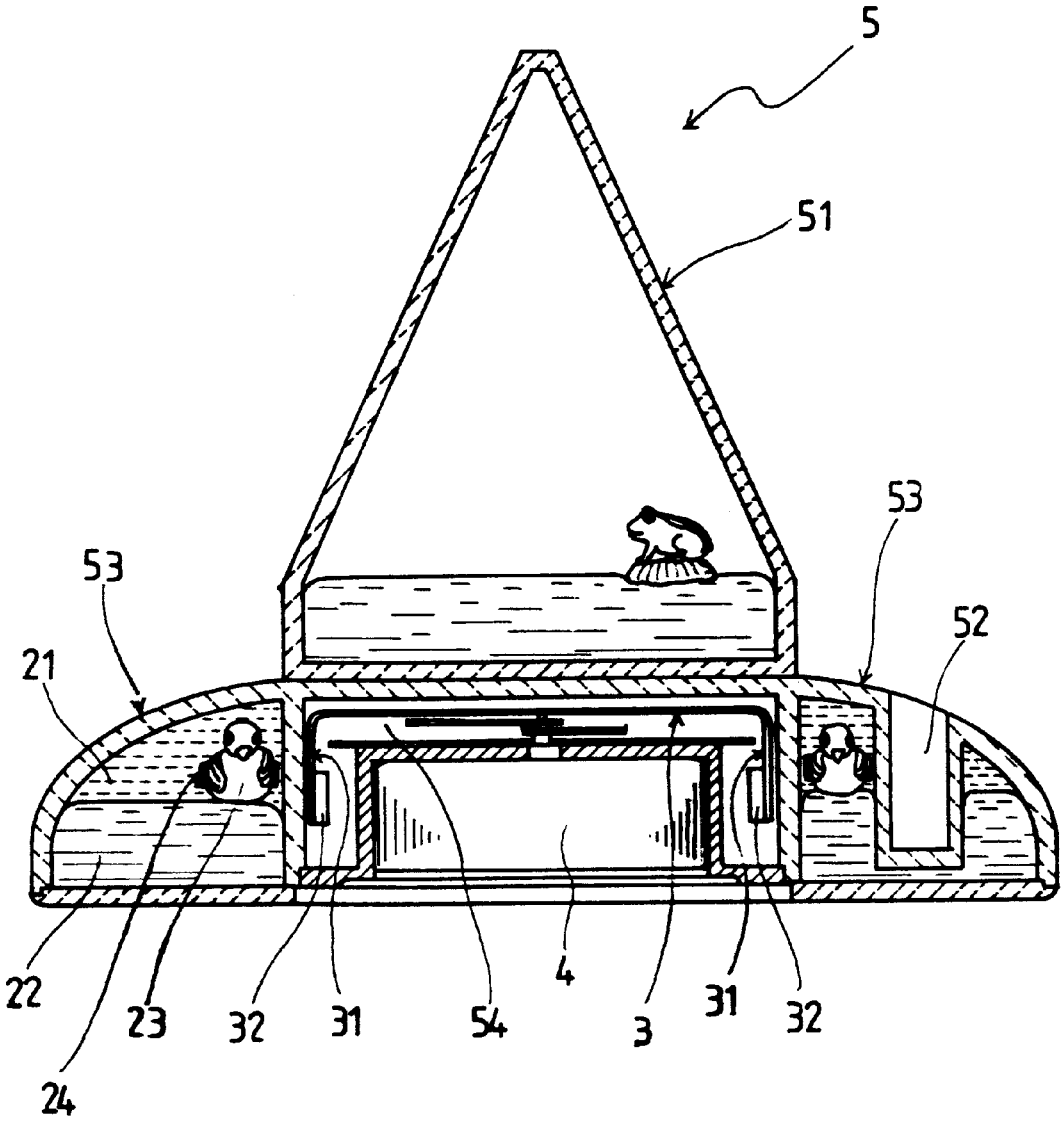
FIG. 4 is a sectional view of the magnetically driven dynamic ornament of FIG. 3.

FIGS. 3 and 4 are perspective and sectional views, respectively, of a dynamic ornament 5 according to a second embodiment of the present invention. The dynamic ornament 5 employs the same driving structure and dual-liquid ornament arrangement as that in the dynamic ornament 1 but has some changes in its appearance, including an additional liquid container having prismatic action and located above a central chamber 54 of the ornament 5, a plurality of pen holders 52 provided in an annular chamber 53 surrounding the central chamber 54, and a second's dial serving as a disc-shaped turnable member 3 having a vertically downward extended peripheral wall 31.

Figure 5:
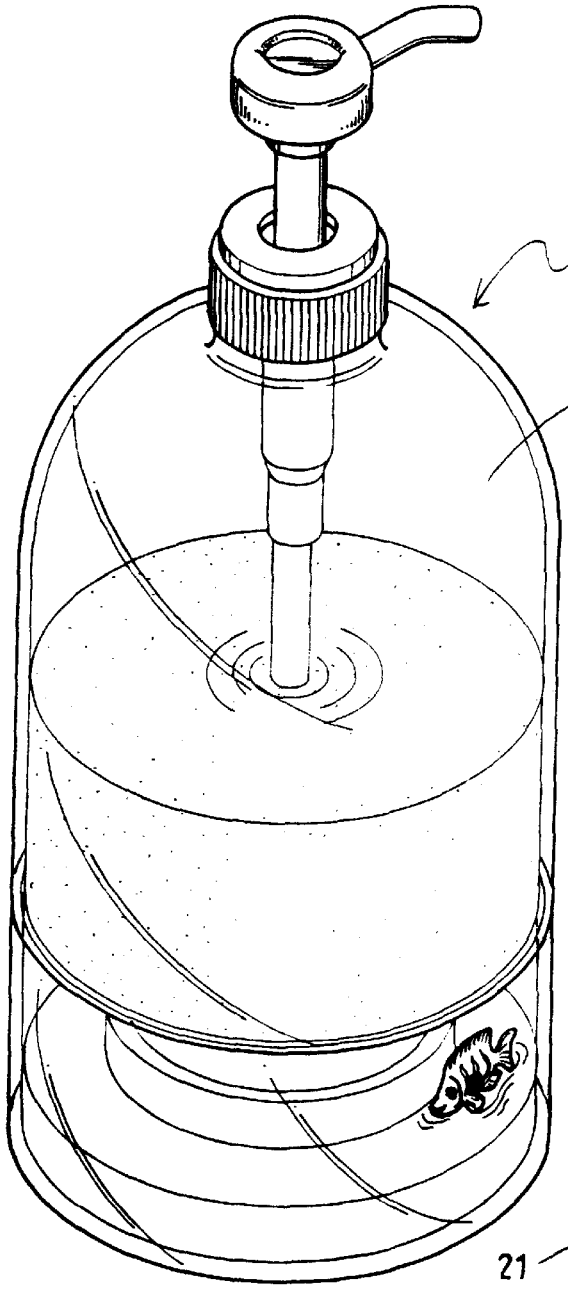
FIG. 5 is a perspective view of a magnetically driven dynamic ornament according to a third embodiment of the present invention.
Figure 6:
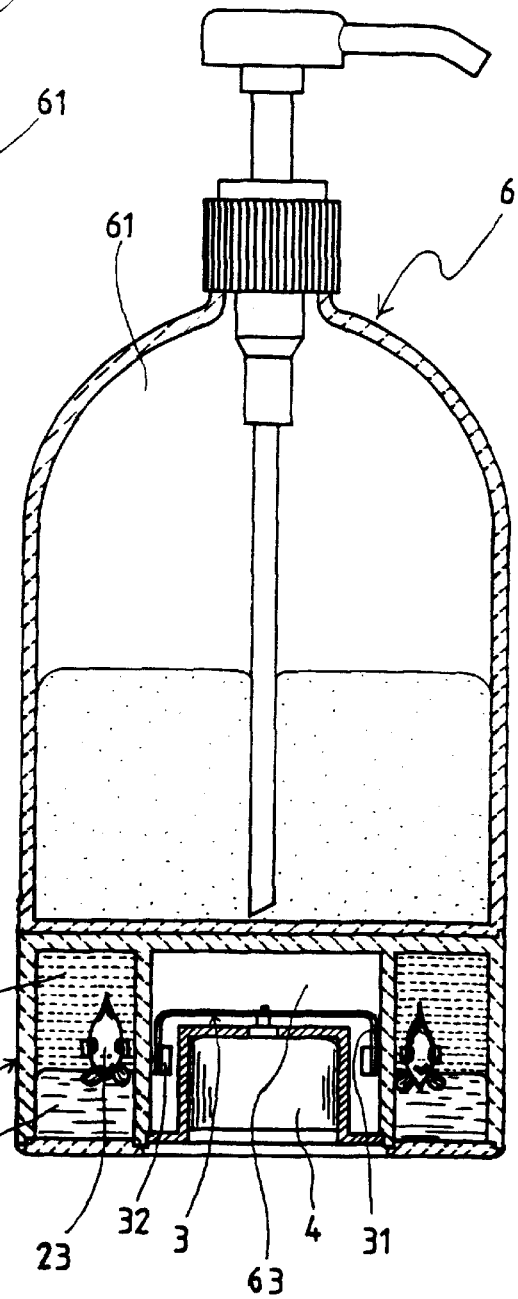
FIG. 6 is a sectional view of the magnetically driven dynamic ornament of FIG. 5.

FIGS. 5 and 6 are perspective and sectional views, respectively, of a bottle-shaped dynamic ornament 6 according to a third embodiment of the present invention. The dynamic ornament 6 includes a milky lotion bottle 61 forming an upper part of the ornament 6 and a container forming a lower part of the ornament 6. The lower container is structurally similar to the dynamic ornament 1 and is divided into a closed annular chamber 62 and a central chamber 63 surrounded by the annular chamber 62. Oil 21, water 22 and floating decorations 23 are received in the annular chamber 62 to provide a dual-liquid ornament. And a turnable member 3 is provided in the central chamber 63 and has magnetic bodies 32 attached to a vertical downward extended peripheral wall 31 thereof.

Figure 7:
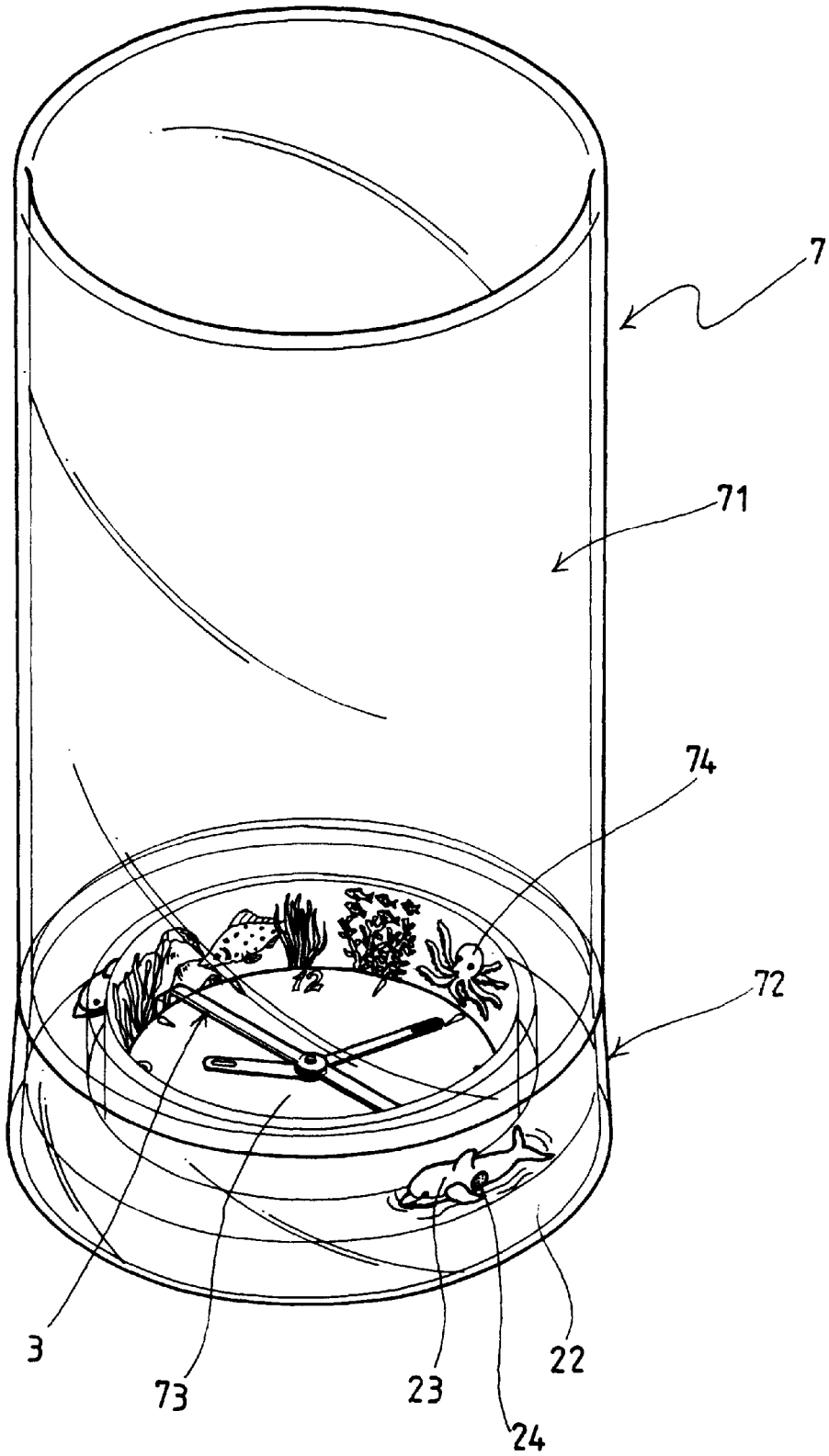
FIG. 7 is a perspective view of a magnetically driven dynamic ornament according to a fourth embodiment of the present invention.

FIG. 7 shows a dynamic ornament 7 according to a fourth embodiment of the present invention. The dynamic ornament 7 includes an upper part that is in the form of an open-topped cylindrical container 71 adapted to serve as a glass or a pen holder, and a lower part structurally similar to the dynamic ornament 1 and having a closed annular chamber 72, a central chamber 73 surrounded by the annular chamber 72 and provided with background designs 74, and an elongated turnable member 3 serving as second hand and magnetic inducing member to drive floating decorations 23 to move in the annular chamber 72.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A magnetically driven dynamic ornament, comprising a horizontally positioned housing divided into a closed annular chamber and a central chamber surrounded by said annular chamber; said annular chamber having a predetermined width for receiving a dual-liquid ornament therein, and said central chamber having a drive source fixedly mounted therein and a horizontal turnable member rotatably mounted to and driven to move by said drive source;

said horizontal turnable member having at least one vertically downward extended end portion to which at least one magnetic body is attached, such that said at least one magnetic body is in the vicinity of magnetic induction bodies attached to floating decorations in said dual-liquid ornament and that only a thin wall between said central chamber and said annular chamber separates said at least one magnetic body from said magnetic induction bodies, enabling said horizontal turnable member in moving to continuously and stably magnetically drive said floating decorations at an interface of oil and water provided in said dual-liquid ornament to move in and along said annular chamber to present a dynamic vision.

2. A magnetically driven dynamic ornament as claimed in claim 1, wherein said housing of said dynamic ornament may be of any shape, and said closed annular chamber has at least one clear side for displaying said dual-liquid ornament.

3. A magnetically driven dynamic ornament as claimed in claim 1, wherein said drive source is a horizontally positioned clock movement and said turnable member is a horizontal second's dial.

4. A magnetically driven dynamic ornament as claimed in claim 1, wherein said drive source is a horizontally positioned clock movement and said turnable member is a double-length second hand.

5. A magnetically driven dynamic ornament as claimed in claim 1, wherein said floating decorations may be in any optional number, and wherein said magnetic induction bodies are attached to two lateral sides of said floating decorations.

6. A magnetically driven dynamic ornament as claimed in claim 1, wherein said at least one magnetic body is adapted to attach to one of an inner and an outer end surface of said at least one vertically downward extended end portion of said turnable member.

7. A magnetically driven dynamic ornament as claimed in claim 1, wherein said at least one magnetic body is a magnet and said magnetic induction bodies are small pieces of iron.

* * * * *